United States Patent [19]

Jurasek

[11] 4,050,606

[45] Sept. 27, 1977

[54] COLLAPSIBLE MATERIAL HANDLING CONTAINER

[75] Inventor: Stanley J. Jurasek, Concord Township, Jackson County, Mich.

[73] Assignee: Eagle Picher Industries, Inc., Cincinnati, Ohio

[21] Appl. No.: 582,780

[22] Filed: June 2, 1975

[51] Int. Cl.[2] ..... B65D 7/24

[52] U.S. Cl. ..... 220/7; 108/55.1; 220/19

[58] Field of Search ..... 108/51, 53, 55, 56; 220/6, 7, 19

[56] References Cited

U.S. PATENT DOCUMENTS

| | | | |
|---|---|---|---|
| 2,776,775 | 1/1957 | Averill | 108/53 X |
| 2,780,383 | 2/1957 | Coit, Jr. | 220/7 |
| 2,806,624 | 9/1957 | Beckner | 220/19 X |
| 2,892,603 | 6/1959 | Averill | 108/55 |
| 3,372,829 | 3/1968 | Averill | 220/19 X |
| 3,383,003 | 5/1968 | Schurch | 220/19 X |
| 3,442,231 | 5/1969 | Jurasek | 108/53 |
| 3,762,593 | 10/1973 | Beretta | 220/6 |
| 3,970,209 | 7/1976 | Baxter | 220/6 |

*Primary Examiner*—Roy D. Frazier
*Assistant Examiner*—William E. Lyddane
*Attorney, Agent, or Firm*—Blanchard, Flynn, Thiel, Boutell & Tanis

[57] ABSTRACT

A collapsible material handling container comprising a deck bed having a plurality of support legs thereon, and a deck mat fixed to the upper surface of the deck bed. A first side wall is hinged along the lower edge thereof to the deck mat, and a pair of opposed end walls are hinged along the front edges thereof to the opposite side edges of the first side wall. A second side wall is hinged along the lower edge thereof to the deck mat. In the erected condition of the container, the second side wall is connectible to the end walls by releasable lock mechanisms. The upper portion of the first side wall may comprise a gate having a releasable lock mechanism which coacts with the end walls for connecting the gate to the walls, in the erected condition of the container. The hinges between the first side wall and the end walls extend vertically along only the lower portion of the first side wall. When the container is to be collapsed, the locking mechanisms associated with the second side wall are released, and the opposed end walls are individually and sequentially folded inwardly to overlap the first side wall. The second side wall is then folded inwardly to directly overlie the deck mat, and then the first side wall, with the end walls folded thereon, is folded inwardly to overlap the second side wall.

1 Claim, 12 Drawing Figures

FIG. 4
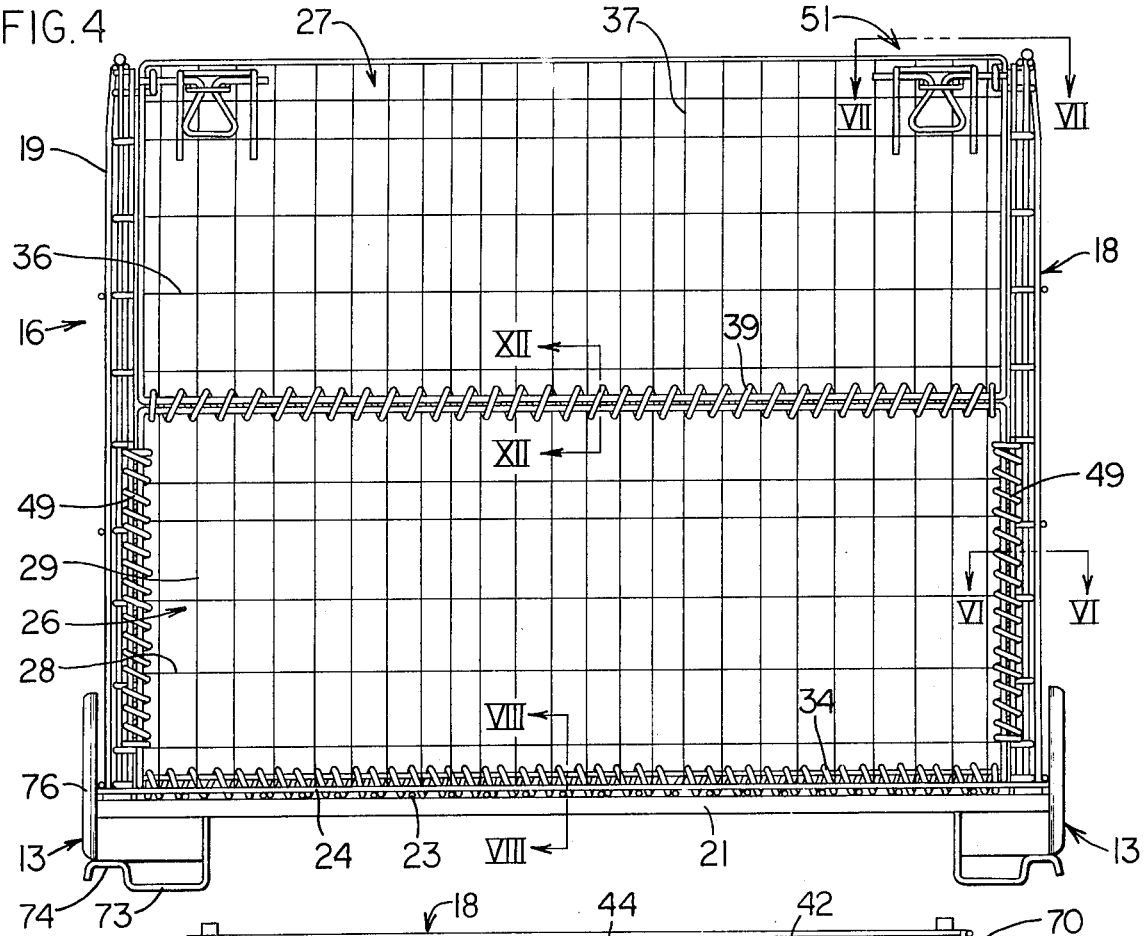
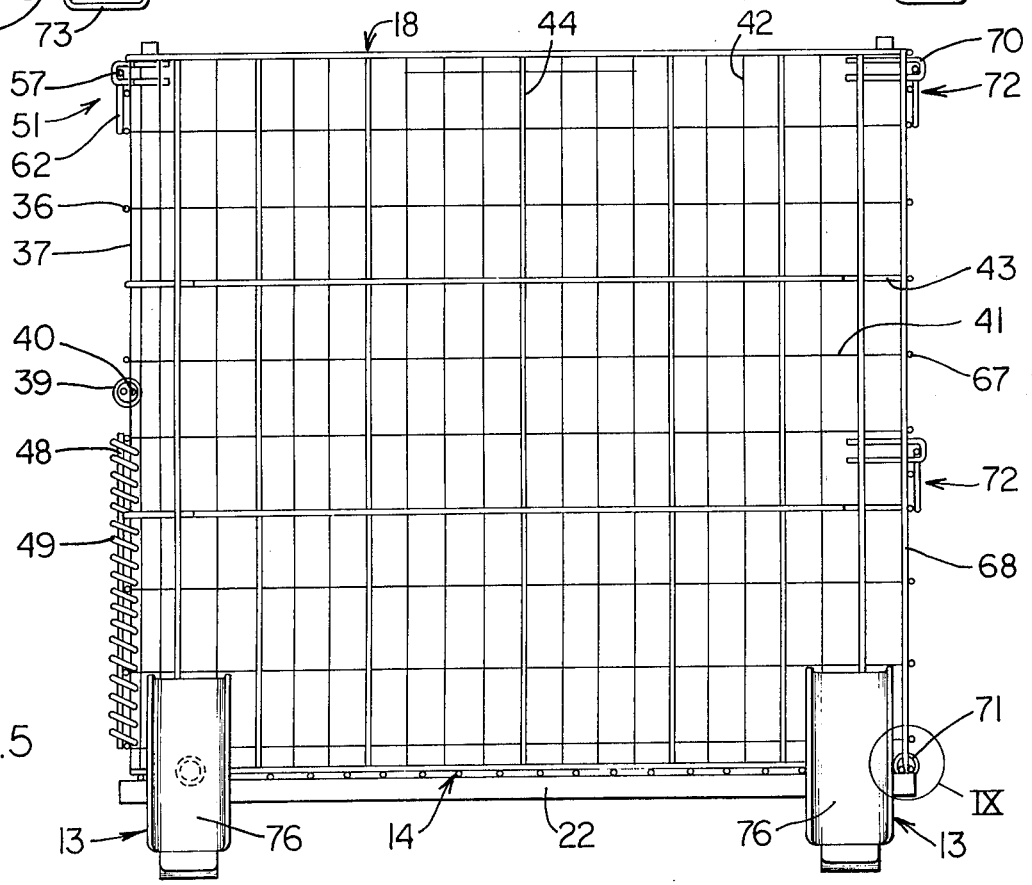
FIG. 5

COLLAPSIBLE MATERIAL HANDLING CONTAINER

BACKGROUND OF THE INVENTION

1. Field of the Invention

This invention relates to a collapsible material handling container and, more particularly, to an improved collapsible container which can be collapsed in a simple and facile manner.

2. Description of the Prior Art

Material handling containers are available in a wide variety of types and constructions. Such containers must be capable of ready handling by fork lift trucks and the containers must be vertically stackable. Many of these known containers are collapsible to reduce the space they occupy when they are not in use. One such container comprises a first side wall which is hingedly connected along one vertical edge thereof to one of the end walls, and a second side wall which is hingedly connected along one vertical edge thereof to the other end wall. The end walls can be folded to overlie the respective side walls, with the side walls in turn being hinged to the base of the container so that they can be folded downwardly to overlie the base. This known container, as illustrated in U.S. Pat. No. 3,442,231, has met with substantial commercial acceptance. However, a disadvantage of this prior container is that the end walls are swung through arcs of about 270° in order to position same in overlapping relationship with the respective side walls. Thus, a substantial free space must be provided around the container when the container is to be collapsed or erected. Further, in order to collapse this prior container, all of the locking hardware used to lock the walls in upright erect positions must be disengaged.

Accordingly, in a continuing effort to improve on both the structural and operational performance of collapsible containers of this general type, the present invention provides a collapsible container which is free from the above-noted disadvantages.

Specifically, it is an object of the present invention to provide an improved collapsible material handling container, as aforesaid, in which the end walls are swung inwardly to collapse the container. The only outward swinging of walls that is required during collapsing is a small outward swinging of the second side wall so that the end walls can be swung inwardly therepast. Thus, the container can be collapsed and erected without requiring substantial free space around it.

It is a further object of the invention to provide an improved collapsible material handling container, as aforesaid, in which only the locking hardware that connects the end walls to the second side wall must be disconnected to effect collapsing. Thus the container can be collapsed in a more facile and efficient manner requiring only a minimum number of manual manipulations.

A still further object of the present invention is to provide an improved collapsible material handling container, as aforesaid, which incorporates a swingable gate associated with the first side wall, or swingable gates in both the first and second side walls, of the container to permit access into the interior of the container, which is strong and durable, and which permits simple and efficient collapsing of the container without requiring any special manipulation of the gate structure.

SUMMARY OF THE INVENTION

The objects and purposes of the present invention are met by providing a collapsible material handling container having a bottom, first and second side walls and a pair of end walls which are all of wire mesh construction. The first side wall is comprised of upper and lower portions of substantially rectangular configuration, and the upper portion is hingedly connected to the lower portion to define a swingable gate. The gate has its lower edge hinged to the upper edge of the lower portion. The lower portion in turn has its lower edge hinged to the bottom wall so that the first side wall is swingable about a substantially horizontal axis. The lower portion of the first side wall has the opposite edges thereof hingedly connected to the adjacent vertical edges of the end walls, so that the opposed end walls can be swingably moved inwardly to overlap the first side wall. The second side wall also has the lower edge thereof hinged to the bottom wall. Releasable lock devices are associated with the second side wall for rigidly connecting same to the adjacent corners of the end walls when the container is in an erected condition. When the container is to be collapsed, the rear locking devices are released, whereupon the end walls are sequentially folded inwardly to overlap one another and also overlap the first side wall. The second side wall is folded downwardly to overlap the bottom wall, and then the first side wall with the end walls overlapped thereon is then folded downwardly to overlie the second side wall.

Other objects and purposes of the invention will be apparent to persons familiar with structures of this type upon reading the following specification and inspecting the accompanying drawings.

BRIEF DESCRIPTION OF THE DRAWINGS

FIG. 4 is a front elevational view of the container.

FIG. 5 is a right side elevational view of the container.

Figure 1:
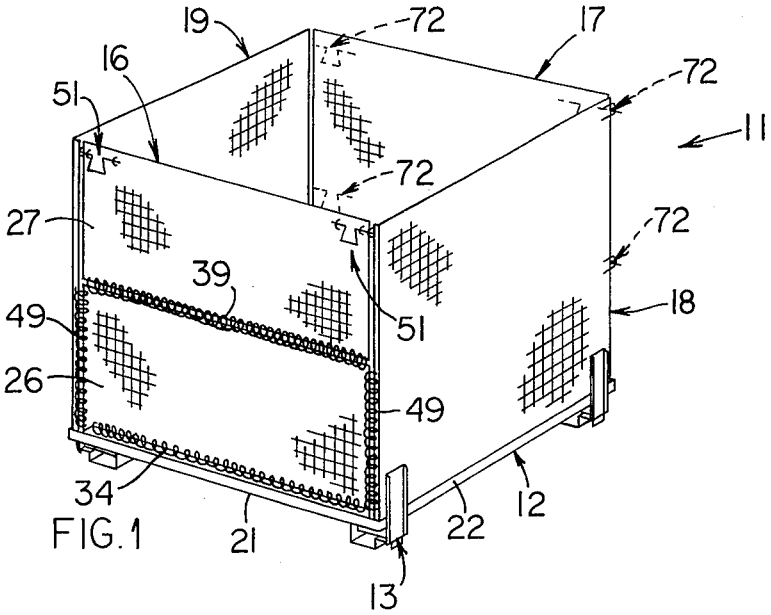
FIG. 1 is a perspective view of a collapsible container according to the invention.

Certain terminology will be used in the following description for convenience in reference only and will not be limiting. For example, the words "upwardly", "downwardly", "rightwardly" and "leftwardly" will refer to directions in the drawings to which reference is made. The words "front" and "rear" will refer to the sides of the container which appear on the left and right sides, respectively, in FIG. 5. The words "inwardly" and "outwardly" will refer to directions toward and away from, respectively, the geometric center of the container and designated parts thereof. Said terminology will include the words above specifically mentioned, derivatives thereof and words of similar import.

DETAILED DESCRIPTION

Referring to FIG. 1, the material handling container 11 embodying the invention comprises a base formed by a rectangular deck bed 12 having legs 13 secured thereon adjacent the corners thereof and also having a deck mat 14 secured to and overlying the bed 12. Substantially rectangular first and second side walls 16 and 17, respectively, extend upwardly from the base adjacent the longitudinally extending edges thereof, which walls extend substantially in parallel with one another and are disposed substantially perpendicular to the deck mat 14. The walls 16 and 17 in turn are interconnected by substantially parallel rectangular right and left end walls 18 and 19, respectively, whereby the walls in cooperation with the base define an enclosure having an upwardly opening boxlike configuration.

The deck bed 12 preferably is of the same construction as the deck bed illustrated in U.S. Pat. No. 3,442,231, although it will be apparent that deck beds of a variety of different constructions can be used. Specifically, the deck bed 12 is comprised of a plurality of structural members such as upwardly opening U-shaped channel sections, including the longitudinally extending side members 21 and the transversely extending end members 22 which are fixedly connected together to form a substantially rectangular frame. Further intermediate channel-shaped members (not shown) are disposed within and interconnected to this latter-mentioned frame. The channel-shaped sections forming the deck bed are suitably fixedly connected to each other, as by welding.

As shown in FIGS. 4 and 5, the deck mat 14 is of a grid-like construction and comprises a lower series of substantially parallel slats or wire rods 23 which extend in parallel relation to the end members 22 and a second series of parallel slats or wire rods 24 that extend in parallel relationship to the side members 21. The rods 23 and 24 are welded to one another where they cross and are also welded to the upper edges of the members 21 and 22 with which they are in engagement. The gridlike arrangement defined by the transversely extending rods 23 and 24 effectively defines the material supporting floor or bottom wall of the container.

The first side wall 16 includes a lower wall portion 26 which projects upwardly from the deck mat 14 and has its upper edge hinged to an upper wall portion 27, which portion 27 functions as a gate and is swingably movable outwardly and downwardly so that it can be positioned in front of the lower wall portion to facilitate access to the contents of the container.

The lower wall portion 26 is of a gridlike construction and comprises an outer series of substantially parallel horizontally extending slats or wire rods 28 and an inner series of substantially vertically extending slats or wire rods 29, which rods 28 and 29 are welded to one another where they cross. These wire rods define the wall portion 26 which is substantially and has rectangular wire mesh configuration.

Figure 8:
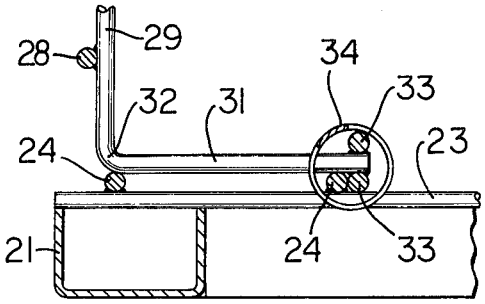
FIG. 8 is an enlarged, fragmentary sectional view taken along line VIII—VIII in FIG. 4.

The lower wall portion 26 also has a leglike part on the lower end thereof which extends inwardly in substantially perpendicular relationship to the plane defined by the rods 28 and 29. This leglike part, as illustrated in FIG. 8, includes a plurality of inwardly extending slats or wire rod portions 31 which are substantially parallel to one another. These rods 31 are fixedly, here integrally, connected to the lower ends of the vertical rods 29, as by being bent from a single elongated rod member thereby resulting in the formation in an intermediate elbow portion 32. The inner ends of the rod portions 31 are fixedly joined by elongated horizontally extending slats or wire rods 33 which are disposed on opposite sides of the rods 31. The rods 33 extend substantially parallel to the rods 28 but are displaced inwardly a substantial distance from the plane defined by the rods 28 and 29, which distance is normally in the order of 3 to 4 inches.

The lower free edge of the lower wall portion 26, as defined by the rods 33, is hingedly connected to the deck mat 14 by a hinge 34, which hinge 34 is formed by a helical wire coil which encircles the rods 33 and one of the rods 24 associated with the deck mat 14. The hinge 34 preferably extends substantially the complete length of the wall portion 26.

As illustrated in FIG. 8, the lower rod 33 is positioned closely adjacent the rod 24 so as to result in a secure but swingable connection between the lower wall portion and the deck mat. At the same time, the rod portions 31 bear upon one of the other rods 24, such as in the vicinity of the elbow portions 32, so as properly to support the front wall when it is in its upright position.

The upper wall portion or gate 27 is also of a rectangular gridlike construction and includes an outer series of substantially parallel horizontally extending slats or wire rods 36 and an inner series of substantially parallel vertically extending slats or wire rods 37, which rods 36 and 37 are welded to one another where they cross.

The upper edge of the gate 27 is reinforced by a further horizontal wire rod 38 which is positioned directly opposite the uppermost wire rod 36 and is suitably welded to the vertical wire rods 37 adjacent the upper free ends thereof. A similar horizontal reinforcing rod 40 (FIG. 12) is associated with the upper edge of the lower wall portion 26 and is positioned directly opposite the uppermost rod 28 and is welded to the upper ends of the vertical rods 29.

Figure 12:
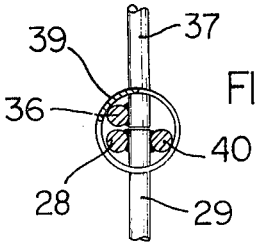
FIG.12 is an enlarged, fragmentary sectional view taken along line XII—XII in FIG. 4.

To permit swinging movement of the gate 27, the lower edge of gate 27 and the upper edge of wall portion 26 are connected by a hinge 39. The hinge 39, in a preferred embodiment, comprises a helical coil wire member which, as illustrated in FIG. 12, surrounds the rods 28, 36 and 40. This helical hinge, which preferably extends throughout the length of the front wall, permits the gate to be swung outwardly and downwardly through an angle of substantially 180° so as to overlap the lower wall portion 26. Thus, the gate 27 preferably comprises no more than approximately one-half of the overall height of the first side wall.

Considering now the right end wall 18, the same is also of a rectangular gridlike configuration and includes an inner series of substantially parallel horizontally extending slats or wire rods 41 and an intermediate series of substantially parallel vertically extending slat or wire rods 42, which rods 41 and 42 are welded together where they cross. A further series of horizontal rods 43 overlie the rods 42 on the side thereof opposite the rods 41, which rods 42 and 43 are also welded together where they cross. Further vertical rods 44 in turn overlie the horizontal rods 43 and are welded thereto at the crossover points.

Figure 6:
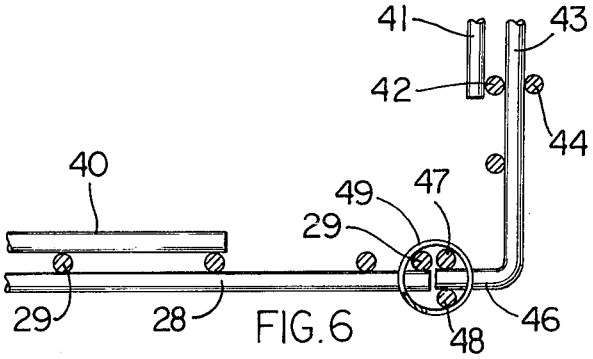
FIG. 6 is an enlarged, fragmentary sectional view taken along line VI—VI in FIG. 4.
Figure 7:
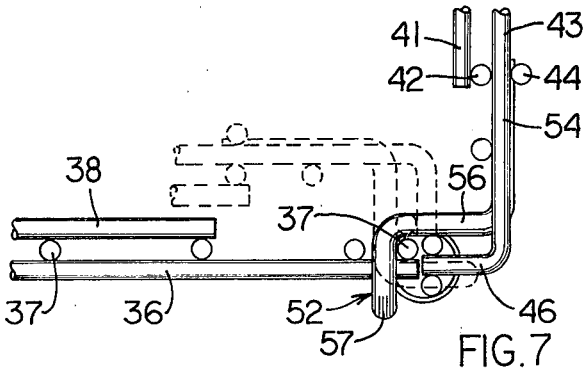
FIG. 7 is an enlarged, fragmentary view taken along line VII—VII in FIG. 4.

The horizontal rods 43 associated with the end wall 18, at least adjacent the forward edge of the end wall, project outwardly beyond the rods 41 as illustrated in FIG. 6. Rods 43 have the free ends thereof bent inwardly at substantially right angles so as to form short transversely extending rod portions 46, which portions 46 are disposed substantially within the plane defined by the horizontally extending rods 28 and 36 associated with the first side wall portions as illustrated in FIGS. 6 and 7. A vertical reinforcing rod 47 extends throughout the height of the end wall 18 adjacent the front edge thereof and is welded to the free ends of the rod portions 46. A further vertical reinforcing rod 48 is disposed directly opposite and substantially parallel to the rod 47 and is welded to the free ends of the rod portions 46. However, the outer reinforcing rod 48 extends vertically only throughout the height of the lower front wall portion 26.

The front edges of the right and left end walls 18 and 19 are respectively hingedly connected to the adjacent edges of the first side wall 16 to permit the first side wall and the ends walls to be swingably moved into overlapping relationship with one another. Thus, hinges 49 each in the form of a helical coil member are respectively disposed adjacent the vertically extending edges of the first side wall and the end walls, which hinge 49 surrounds the vertical rods 47 and 48 associated with the respective end walls and also surrounds the outermost vertical rod 29 associated with the lower wall portion 26. The hinge 49 extends vertically throughout the height of the lower front wall portion 26 as illustrated in FIGS. 4 and 5.

Figure 10:
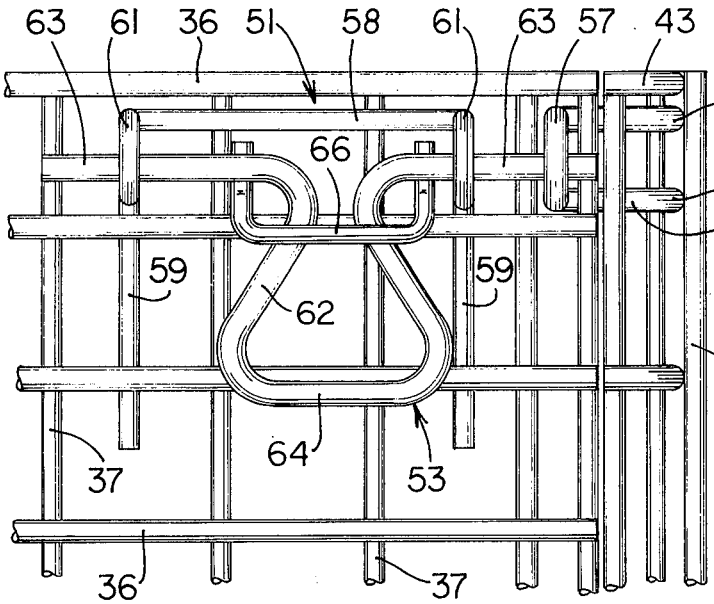
FIG. 10 is an enlarged view of a fragment of FIG. 5.

To permit the gate 27 to be maintained in the closed position illustrated in FIGS. 1 and 4, releasable latch structures 51 coact between the adjacent upper corners of the first side wall 16 and end walls 18 and 19, respectively. Each of the releasable latch structures 51, which are similar to the latch structure disclosed in U.S. application Ser. No. 323,513, now U.S. Pat. No. 3,907,150, owned by the assignee of this application, includes (see FIGS. 10 and 11) a keeper 52 secured to the edge of the end wall 18 and a latch 53 mounted on the gate 27 adjacent the upper corner thereof.

Figure 11:
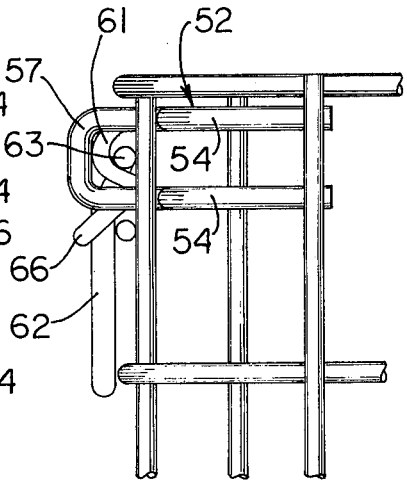
FIG. 11 is a right side view of FIG. 10.

The keeper 52, when viewed from the top (FIG. 7), is of a substantially Z-shaped configuration, and it is of a substantially U-shaped configuration when viewed in front view (FIG. 11). The keeper 52 is a one-piece U-shaped wire rod having substantially parallel leg portions 54 which are welded to the vertical rods 44 of the end wall. Leg portions 54 are bent inwardly at substantially right angles to form parallel intermediate rod portions 56 which are disposed inwardly but substantially parallel to the rod portons 46. Intermediate rod portions 56 in turn are bent outwardly at right angles to form a forwardly projecting loop portion 57 which is spaced inwardly from but projects beyond the free ends of the rod portions 46. When the gate 27 is in its closed position, the loop portion 57 projects through the gridlike structure of the gate and the edgemost vertical rod 37 of the gate overlaps the loop portions 57 and abuts against the intermediate portons 56, which portions 56 function as stops for defining the closed position of the gate.

The latch 53 includes a one-piece rod 58 which is fixed to the gate and includes a pair of downwardly projecting vertical legs 59 welded to the horizontal rods 36. Reversely bent, forwardly projecting loop portions 61 are provided at the upper ends of the legs 59, which loop portions 61 are substantially aligned with the loop portion 57 when the gate is closed. A latch member 62 is slidably supported on the loop portions 61 and includes an intermediate handle portion 64 and oppositely extending latch portions 63 which project outwardly through and are slidably supported on the loop portions 61. The latch member 62 is both slidably and pivotally supported on the loop portions 61. A U-shaped stop member 66 is fixedly secured to the latch member 62, and the legs of the stop element 66 are adapted to project between the vertical rods 37. When the latch member is swung upwardly to a substantially horizontal position, the latch member 62 can then be slidably displaced horizontally to permit the outermost latch portion 63 to be inserted through or withdrawn from the loop portion 57. When the handle 64 is released, the latch member will return to its vertical position, by gravity. When in this lower vertical position, accidental displacement of the latch member 62 is prevented due to the legs of the stop element 66 abutting against one of the vertical rods 37.

The latch structure 51, and specifically the Z-shaped configuration of the keeper 52, is advantageous since it permits the end walls to be vertically swung about the hinges 49 so as to be moved into overlapping relationship with the first side wall 16, substantially as illustrated by dotted lines in FIG. 7. This swinging movement between the first side wall and the end walls can be accomplished without releasing the latch structures 51.

Considering now the left end wall 19, same is a mirror image of the right end wall 18 and thus detailed description thereof is believed unnecessary. The left end wall 19, like the right end wall 18, is also hingedly connected to the first side wall 16 and for this purpose the lower front edge of the left end wall 19 is hinged to the leftward edge of the lower wall portion 26 by means of a further helical coil member 49. The upper edge of the left end wall 19 is also fixedly connectible to the upper left corner of the gate 27 by means of a further latch structure 51.

Figure 9:
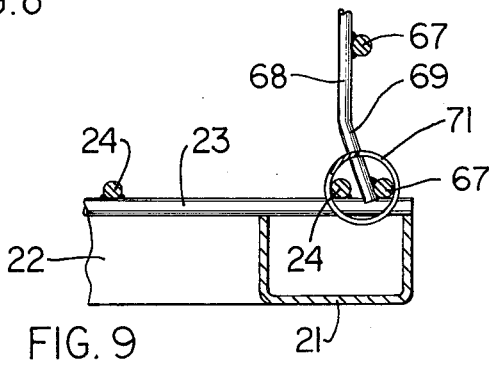
FIG. 9 is an enlarged, fragmentary sectional view of the portion contained in circle IX in FIG. 5.

Considering now the second side wall 17, same similarly is of a rectangular gridlike construction and includes an outer series of substantially parallel horizontally extending slats or wire rods 67 and an inner series of substantially parallel vertically extending slats or wire rods 68, which rods 67 and 68 are welded together where they cross. The lower ends of the vertical rods 68 are provided with an outwardly bent portion 69 (FIG. 9) on the lower ends thereof, which bent portions are fixedly connected by the lowermost horizontal wire rod 67.

The second side wall 17 is hingedly connected to the deck mat 14 to permit the second side wall to be folded down into overlapping relation with the deck mat when the container is collapsed. For this purpose, there is provided a hinge 71 which preferably constitutes an elongated helical coil wire member which extends along the lower edge of the second side wall and is disposed so as to surround the lowermost horizontal wire 67 secured to the second side wall and the rearwardmost longitudinally extending wire 24 associated with the deck mat 14.

To maintain the second side wall 17 in its upright position when the container is in an assembled or erected condition, there are provided releasable latch structures 72, which latch structures are disposed adjacent the upper corners of the second side wall and coact with the adjacent corners of the end walls 18 and 19. The latch structure 72 is identical to the latch structure 51 except for the configuration of the keeper. As noted above, the keeper 52 associated with the latch structure 51 is of Z-shaped configuration to permit relative hinging movement between the first side wall and the end walls when the latch structure is in its closed or locked position. On the other hand, this type of movement is not required between the second side wall 17 and the end walls 18 and 19, so that the keeper 70 associated with the latch structure 72 can be a substantially planar U-shaped member, rather than being of a Z-shaped configuration.

The end walls 18 and 19 are not hingedly connected to the second side wall 17. The second side wall 17 is somewhat longer than the first side wall 16 and the rearward ends of the ends walls 18 and 19 do not include inwardly extending portions corresponding to the portions 46 at the front ends thereof. Thus, the second side wall 17 abuts the rearward ends of the end walls 18 and 19 and is releasably secured thereto, when in erected condition, by means of the latches 72. The second side wall 17 can be of one piece construction or it can be comprised of two hingedly connected sections, like the first side wall 16, to provide gates for access to the contents of the container. For this purpose, upper and lower pairs of latch structures 72 are provided so that each section of the second side wall can be independently latched in an upright position.

With respect to the legs 13, each includes a foot portion 73 which projects downwardly below the deck bed to permit the container to rest on a suitable support surface and additionally permits the tines of a lift truck to be inserted under the deck bed. The foot portion 73 is disposed substantially within the outline defined by the container but in addition includes a downwardly opening channel-shaped portion 74 which is disposed under the side walls of the container. Each leg 13 also includes an upwardly projecting channel-like leg 76 which projects upwardly from the channel portion 74. The leg portion 76 projects upwardly a sufficient extent so as to have the upper end thereof spaced above the container when it is in the collapsed position illustrated in FIG. 3. Leg portions 76 permit vertical stacking of the collapsed containers. The containers can also be stacked in a non-collapsed condition since the channel-shaped portions 74 of an upper container will engage the upper edges of the side walls of a lower container.

The structure of the legs is more fully described in Ser. No. 582,746, filed June 2, 1975, now abandoned, the entire contents of which are incorporated herein by reference.

OPERATION

When the container 11 is in its assembled or erected condition illustrated in FIG. 1, the four walls of the container are suitably fixedly interconnected to thereby maintain the container in a rigid condition. This rigid relationship is achieved by the rear latch structures 72 which fixedly connect the opposite edges of the second side wall 17 to the adjacent rear edges of the end walls 18 and 19, respectively. The end walls 18 and 19 in turn are connected to the lower portion of the first side wall 16 by the hinges 49. The gate 27, when in its closed position, is likewise maintained in its upright position due to the interconnection between the gate and the adjacent end walls as provided by the latch structures 51.

When the gate 27 is to be moved into its open position, then the latch members 62 associated with the front latch structures 51 are retracted inwardly so as to remove the pinlike latch portions 63 from the keeper loops 57, whereupon the gate 27 can then be swung outwardly and downwardly so as to overlap the lower wall portion 26 and thereby permit free access into the interior of the container. The access provided by the gate is particularly desirable in those instances where several containers are vertically stacked on top of one another. When a gated second side wall 17 is provided, the gate thereof can be opened and closed in like fashion.

Figure 2:
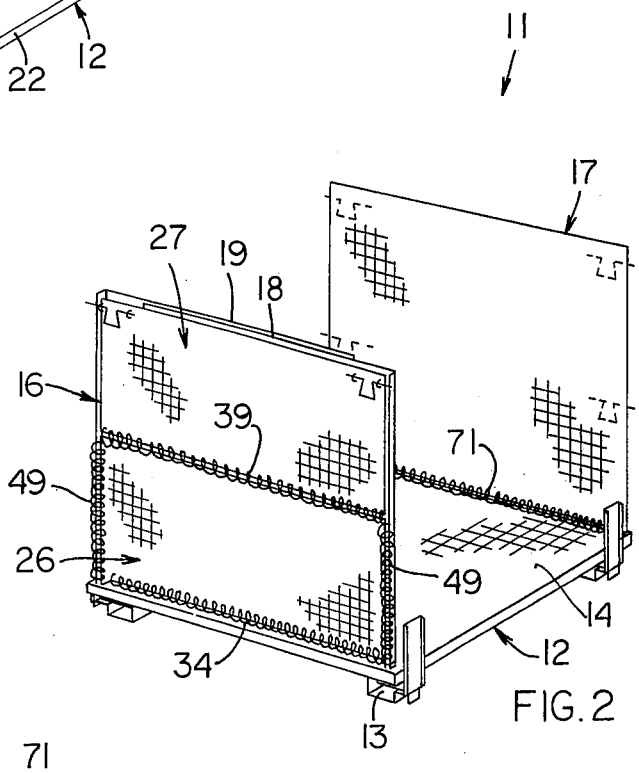
FIG. 2 is a perspective view similar to FIG. 1 and illustrating the container in a partially collapsed condition.
Figure 3:
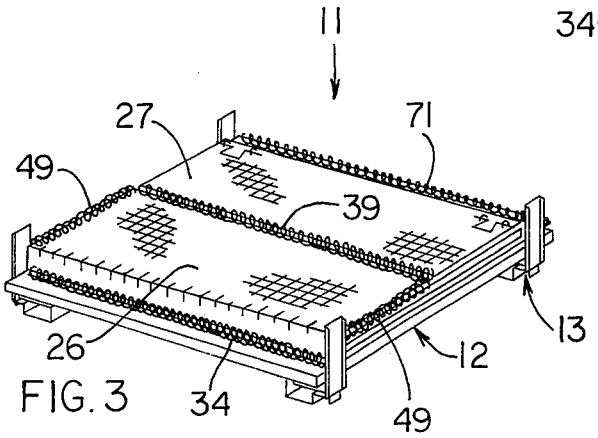
FIG. 3 is a perspective view illustrating the container in a fully collapsed position.

When the container 11 is to be collapsed to facilitate storage or handling thereof, and assuming that the gate 27 is in its closed position and is latched to the end walls 18 and 19, then the rear lock structures 72 are manually released to disconnect the second side wall 17 from the end walls 18 and 19. The second side wall 17 is then swung outwardly about the hinge 71 through an arc of limited angular extent to clear the keepers 70. The opposed end walls 18 and 19 are then individually and sequentially swung or folded inwardly toward the first side wall 16 so that the end walls 18 and 19 overlap one another and also overlap the first side wall substantially as illustrated in FIG. 2. This overlapping relationship between the first sidewall and the two end walls is greatly facilitated by the fact that the hinge axes defined by the hinges 49 are offset inwardly to permit the end walls to be disposed in a relationship which is more closely parallel with the first side wall. When the container is in the partially collapsed condition illustrated in FIG. 2, then the second side wall 17 is folded inwardly about the hinge 71 so that the second side wall rests on and overlies the deck mat 14. The first side wall 16, and the overlapping end walls 18 and 19, are then folded inwardly and downwardly as a unit so as to overlie the already folded-down second side wall. This results in the container having a complete collapsed condition substantially as illustrated in FIG. 3. The folding down of the first side wall 16 and overlapping end walls 18 and 19 from the position illustrated in FIG. 2 into the position illustrated in FIG. 3 is greatly facilitated by the fact that the hinge axis defined by the hinge 34 is offset rearwardly from the vertical plane of first side wall 16 by a substantial distance, which offset permits the walls of the container 10 when in the collapsed position to lie substantially parallel to the deck mat 14.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A collapsible container comprising base means defining a planar bottom wall, substantially parallel first and second planar side walls connected to said bottom wall and adapted to project substantially perpendicularly therefrom adjacent opposite edges thereof, said first side wall comprising a lower wall portion and an upper wall portion whose adjacent horizontal edges are hingedly connected together so that the upper wall portion can be swung outwardly relative to the lower wall portion, said first side wall having an inwardly directed offset portion on the lower end thereof which is substantially parallel to said bottom wall when said container is in an erected condition, the free edge of said offset portion being spaced inwardly from the upwardly extending portion of said first side wall, a pair of substantially parallel planar end walls adapted to project substantially perpendicularly from said bottom wall, said end walls each adapted to extend substantially perpendicularly between said side walls, said end walls having end portions which extend substantially perpendicularly to the planes of said end walls, said end portions extending inwardly toward each other and being substantially coplanar with said first side wall, said walls all being of a substantially rectangular configuration so that said container when in an erected condition defines an enclosure of an upwardly opening boxlike configuration, first hinge means defining a first substantially horizontal hinge axis and hingedly connecting the lower wall portion of said first side wall adjacent the lower horizontal edge thereof to said bottom wall to permit said first side wall to be vertically swung downwardly so as substantially to overlie said bottom wall, said first hinge means being hingedly connected between the free edge of said offset portion and said bottom wall, second hinge means defining a second substantially horizontal hinge axis and hingedly connecting said second side wall adjacent the lower horizontal edge thereof to said bottom wall to permit vertically swinging of said second side wall into a position wherein it overlies said bottom wall, said first and second horizontal hinge axes being substantially parallel to one another, third and fourth hinge means hingedly connecting the opposite side edges of the lower wall portion of said first side wall to the adjacent edges of said end walls to permit said end walls to be swingably displaced to substantially overlie said first side wall, said third and fourth hinge means defining third and fourth hinge axes which extend substantially vertically when the container is in an erected condition, said third and fourth hinge means hingedly connecting the inner edges of said end portions of said end walls to the opposing edges of the lower wall portion of said first side wall, first releasable latch means coacting between said upper wall portion of said first side wall and said end walls for releasably retaining said upper wall portion of said first side wall and said end walls together when the container is in an erected condition, said first releasable latch means comprising two latches respectively disposed adjacent the upper corners of said upper wall portion of said first side wall, each of said latches comprising a keeper having a first portion extending parallel to the plane of its associated end wall and secured thereto, a second portion extending inwardly and substantially parallel to the end portion of its associated end wall and spaced inwardly therefrom and a forwardly projecting loop portion which is substantially parallel to the plane of its associated end wall and is spaced inwardly therefrom and is also spaced inwardly from the edge of the end portion of its associated end wall and is adapted to extend through and project forwardly beyond the upper wall portion of said first side wall, and a latch member mounted on said upper wall portion of said first side wall and adapted to extend through said loop portion in the locked condition of said latch, said loop portion being shaped so that its associated end wall can be swung inwardly to a position substantially parallel to and overlapping said first side wall without interfering with said latch member, said upper wall portion of said first side wall being free of connection to said end walls except through said first latch means, and second releasable latch means coacting between said second side wall and said end walls for retaining these walls together when the container is in an erected condition, said second side wall being free of connection to said end walls except through said second latch means.

* * * * *